US009278837B2

(12) United States Patent
Aristi Artolazabal

(10) Patent No.: US 9,278,837 B2
(45) Date of Patent: Mar. 8, 2016

(54) HYDRAULIC JACK WITH LOCKING

(75) Inventor: Juan Martín Aristi Artolazabal, Berriz (ES)

(73) Assignee: MELCHOR GABILONDO, S.A. (ES)

( * ) Notice: Subject to any disclaimer, the term of this patent is extended or adjusted under 35 U.S.C. 154(b) by 182 days.

(21) Appl. No.: 14/115,746

(22) PCT Filed: Apr. 26, 2012

(86) PCT No.: PCT/ES2012/000111

§ 371 (c)(1),
(2), (4) Date: Nov. 5, 2013

(87) PCT Pub. No.: WO2012/152961

PCT Pub. Date: Nov. 15, 2012

(65) Prior Publication Data

US 2014/0061560 A1 Mar. 6, 2014

(30) Foreign Application Priority Data

May 6, 2011 (ES) ..... 201100495

(51) Int. Cl.

| | |
|---|---|
| ***B66F 3/30*** | (2006.01) |
| ***B66F 5/04*** | (2006.01) |
| *B66F 3/42* | (2006.01) |
| *B66F 3/24* | (2006.01) |
| *B66C 23/48* | (2006.01) |
| *B66F 1/08* | (2006.01) |

(52) U.S. Cl.

CPC ... *B66F 3/30* (2013.01); *B66F 5/04* (2013.01); *B66C 23/48* (2013.01); *B66F 1/08* (2013.01); *B66F 3/24* (2013.01); *B66F 3/42* (2013.01)

(58) Field of Classification Search

CPC ..... B66F 3/30; B66F 3/42; B66F 5/04; B66F 1/08; B66F 3/24; B66C 23/48

USPC ..... 254/93 H, 8 B

See application file for complete search history.

(56) References Cited

U.S. PATENT DOCUMENTS

| | | | | |
|---|---|---|---|---|
| 3,309,062 A * | 3/1967 | Jansz | ..... | 254/93 VA |
| 3,758,076 A * | 9/1973 | Tranchero | ..... | 254/8 R |
| 4,222,548 A * | 9/1980 | John | ..... | B66F 5/04 254/8 B |

(Continued)

FOREIGN PATENT DOCUMENTS

| | | |
|---|---|---|
| AU | 614060 B2 | 8/1991 |
| FR | 2857656 A1 | 1/2005 |

(Continued)

*Primary Examiner* — Monica Carter
*Assistant Examiner* — Mahdi H Nejad
(74) *Attorney, Agent, or Firm* — Cantor Colburn LLP

(57) ABSTRACT

Hydraulic jack (1, 1') comprising a main body (2), an articulated lifting arm (3) and a hydraulic cylinder (4) connected to the main body (2) by a first articulated connection (5) and to the lifting arm (3) by a second articulated connection (6), where the hydraulic jack (1, 1') comprises a lever member (7, 7') disposing of at least one locking zone (14) for receiving an element that is solidary to the lifting arm (3) and that serves as a stop, where the lever member (7, 7') is articulately connected to the first articulated connection (5). The element solidary to the lifting arm (3) that serves as a stop and is capable of lodging in at least one locking zone (14) is comprised in the second articulated connection (6). This way, a mechanical locking system is provided which presents optimal performance while minimizing the number of necessary components.

7 Claims, 7 Drawing Sheets

(56) References Cited

U.S. PATENT DOCUMENTS

| | | | | | |
|---|---|---|---|---|---|
| 4,241,899 | A * | 12/1980 | Kaneko | B66F 5/04 | 254/8 B |
| 4,251,056 | A * | 2/1981 | Maniglia | B66F 17/00 | 254/8 B |
| 4,289,298 | A * | 9/1981 | Kameda | 254/8 B | |
| 4,289,299 | A * | 9/1981 | Kameda | 254/8 B | |
| 4,334,667 | A * | 6/1982 | Fox | B66F 5/04 | 251/251 |
| 4,513,950 | A * | 4/1985 | Yamagishi | 254/8 B | |
| 4,678,162 | A * | 7/1987 | Yang | B66F 3/12 | 254/1 |
| 5,221,073 | A * | 6/1993 | Shockley | 254/8 B | |
| 5,618,029 | A * | 4/1997 | Chung | 254/8 B | |
| 5,878,996 | A * | 3/1999 | Loan | 254/8 B | |
| 5,984,270 | A * | 11/1999 | Hussaini et al. | 254/8 B | |
| 7,108,245 | B2 * | 9/2006 | Lin | 254/8 B | |
| 7,137,615 | B2 * | 11/2006 | Ray et al. | 254/10 B | |
| 8,066,259 | B2 * | 11/2011 | Fang et al. | 254/8 B | |
| 8,905,377 | B2 * | 12/2014 | Shen et al. | 254/8 B | |
| 8,925,899 | B2 * | 1/2015 | Aristi Artolazabal | 254/93 H | |
| 2001/0050359 | A1 * | 12/2001 | Tominaga et al. | 254/8 B | |
| 2008/0111117 | A1 * | 5/2008 | Wu | 254/8 R | |
| 2008/0128670 | A1 * | 6/2008 | Bogert | 254/93 H | |
| 2008/0173852 | A1 * | 7/2008 | Woodbury et al. | 254/8 B | |
| 2009/0283733 | A1 * | 11/2009 | Lyashevskiy et al. | 254/5 R | |
| 2011/0024705 | A1 * | 2/2011 | Fox et al. | 254/2 B | |
| 2011/0062401 | A1 * | 3/2011 | Shen et al. | 254/93 R | |
| 2012/0223280 | A1 * | 9/2012 | Zhou | 254/8 B | |
| 2015/0224967 | A1 * | 8/2015 | Rensink | B60S 9/10 | 254/93 R |

FOREIGN PATENT DOCUMENTS

| | | | |
|---|---|---|---|
| FR | 002857656 | A1 * | 1/2005 |
| GB | 2034408 | A | 6/1980 |
| GB | 2183598 | A | 6/1987 |
| WO | 2010133727 | A1 | 11/2010 |

* cited by examiner

HYDRAULIC JACK WITH LOCKING

TECHNICAL FIELD

The invention refers to a hydraulic jack of the type used in garages and vehicle repair shops for lifting vehicles and facilitating access to their various parts.

PRIOR ART

Hydraulic jacks are devices widely used in garages and vehicle repair shops for lifting motor vehicles so they may be serviced or repaired in a comfortable and secure way by facilitating the access of the operator to areas of the vehicle that are generally difficult to reach. Commonly known hydraulic jacks are usually operated as follows: part of the jack is inserted underneath the vehicle; a lever of the jack is operated causing a hydraulic cylinder to activate a lifting arm of the jack, which is raised and comes in contact with the underside of the vehicle; the continued operation of the lever causes the hydraulic cylinder to push said lifting arm, which exerts an ascending force to the vehicle's underside resulting in the elevation of the vehicle; when the vehicle has reached the desired height, trestles or other supports are introduced underneath the vehicle and the jack is removed. Said supports maintain the vehicle elevated until it needs to be lowered, at which point the jack is inserted once more and the process is repeated in reverse.

It is convenient that hydraulic jacks like the one described above are provided with some type of locking system or mechanism allowing the jack to maintain the vehicle elevated, thereby guaranteeing safety in the event that a hydraulic fault of the jack should cause the load to abruptly descend before trestles or supports are introduced, with the danger that this would entail. For this purpose, it is useful that the jack be provided with a locking mechanism that allows the lifting arm to be locked in a certain position so it cannot descend, thereby supplementing the hydraulic locking provided by the hydraulic cylinder when the latter is stretched in a fixed position and is not being operated. Said locking must also be sufficiently strong and resistant to ensure that the locked arm is able to support the position of the vehicle without being dislodged.

There are some examples of hydraulic jacks with mechanical locking known to the prior art. For example, the hydraulic jack disclosed in document GB2183598A is provided with a lifting arm that has a solidary geared plate that is engageable by a cable-operated pivotable support, so that the pivotable support is able to lock the lifting arm in different positions or heights depending on which gear of the geared plated is engaged. Additionally, U.S. Pat. No. 5,618,029 refers to a hydraulic jack with lifting arm, from which another articulated arm is extended that engages at one end with the row of gears of a straight geared base as the lifting arm is raised. Patent application US20080111117 shows a similar hydraulic jack to the preceding one, in which an articulated arm also extends from the lifting arm and engages with the row of gears on a curved geared piece. These designs are not widely known on the market, most probably due to the fact that they are excessively complex, rendering their manufacture more difficult and expensive.

Another example known to prior art is the international patent application WO2010133727A1 by the same applicant as the one of the present invention, which introduces a new design for a hydraulic jack with locking mechanism. The locking mechanism of said international patent application comprises a main body and an articulated lifting arm that can be raised in relation to the main body by means of a hydraulic system. The lifting arm can be locked by means of a mechanical locking system based on a lever member that can be tilted in relation to the main body, i.e. it rotates in relation to a screw that is located in a bushing solidary to the lever member. The lever member is actuated by a spring in a locking direction and can be actuated by a user in an unlocking direction. The lever member comprises a first curved area and a second curved area, both of which are separated by a step. The lifting arm comprises a rotatable stop that rolls along the first curved area or the second curved area when the lifting arm is rotated, and engages with the step in order to lock the lifting arm and prevent it from rotating in descending direction.

The hydraulic system of the jack presented in WO2010133727A1, just like the one used in other previously known hydraulic jacks, is characterised in that it presents a hydraulic cylinder, the ends of which are connected in such a way that the direction the cylinder lies in does not vary, i.e. in a way that the hydraulic cylinder does not rotate when the lifting arm reclines. In this type of hydraulic jacks, the pusher end of the hydraulic cylinder acts upon a tie rod that in turn is articulately connected to the lifting arm. This design is necessary for relatively small-sized hydraulic jacks.

However, there are other hydraulic jacks with hydraulic cylinders, the ends of which are articulately connected in such a way that the direction of the hydraulic cylinder changes while the lifting arm reclines. This type of solutions eliminates the need of a tie rod, since the hydraulic cylinder's pusher end is able to directly act upon the lifting arm. This type of solutions is usually applied in long hydraulic jacks that have sufficient space for housing a hydraulic cylinder of sufficient size (power) between the rear end of the hydraulic jack and the lifting arm.

The objective of the present invention is to offer a design of a hydraulic jack with mechanical locking that provides a solution as effective and safe as the one suggested in document WO2010133727A1 and that is applicable to hydraulic jacks with articulated hydraulic cylinders (generally, long hydraulic jacks). An additional objective of the present invention is to offer a technically less complex mechanical locking design, i.e. a design that helps reduce the number of components or elements necessary for its operation and/or that is easier to manufacture.

BRIEF DESCRIPTION OF THE INVENTION

The object of this invention is a hydraulic jack that comprises a main body, a lifting arm that is articulated in relation to the main body for lifting a vehicle and a hydraulic cylinder for activating the lifting arm. The hydraulic cylinder is connected to the main body by a first articulated connection and to the lifting arm by a second articulated connection, as is usually the case in, for example, long hydraulic jacks, where the hydraulic cylinder is located between the rear end of the hydraulic jack and the lifting arm. The hydraulic jack comprises a lever member that is able to rotate in relation to the main body in a locking direction o in an unlocking direction, disposing of at least one locking zone for receiving an element solidary to the lifting arm that serves as a stopping element. The hydraulic jack according to the invention presents two particular features: on the one hand, the lever member is connected articulately to the main body in the first articulated connection, i.e. the articulated connection between the lever member and the main body coincides with the articulated connection between the hydraulic cylinder and the main body; on the other hand, the element solidary to the lifting arm serving as a stopping element and capable of lodging in at least one locking zone is comprised in the second articulated connection, i.e. the second articulated connection not only serves as an articulated connection between the hydraulic cylinder and the lifting arm, but it is also used as a stopping element in the locking mechanism.

This way, the invention takes full advantage of the components already present in a hydraulic jack (the first articulated connection and the second articulated connection) in such a way that the only additional component required for providing said jack with a mechanical locking mechanism is the afore-mentioned lever member.

BRIEF DESCRIPTION OF THE DRAWINGS

Details of the invention are depicted in the accompanying figures, which are intended to be illustrative and non-limiting.

DETAILED DESCRIPTION OF THE INVENTION

Figure 1:
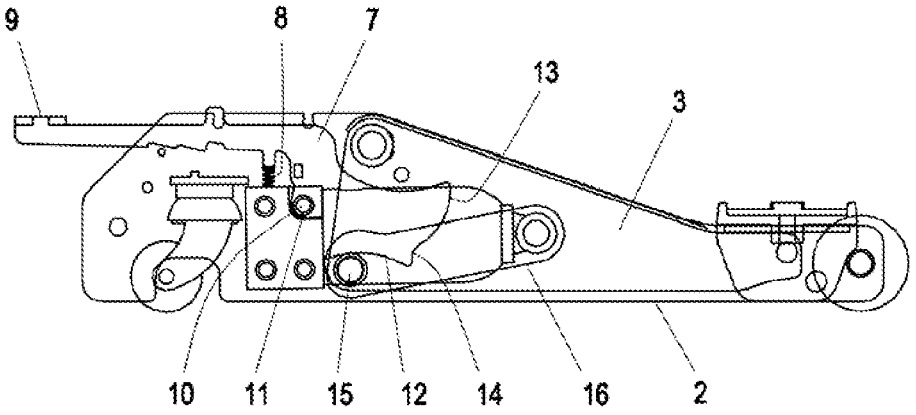
FIGS. 1 and 2 show two section views of the hydraulic jack with locking presented in WO2010133727A1, in the respective idle and locked situations.
Figure 2:
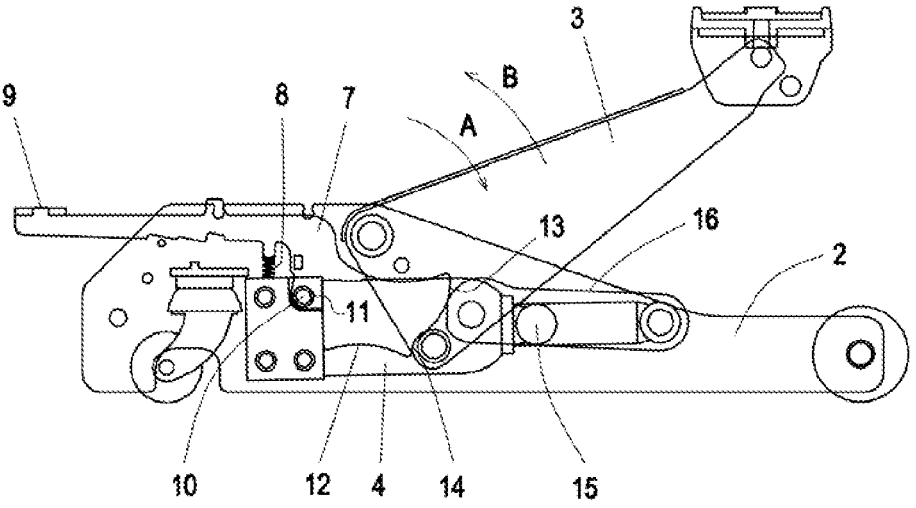

FIGS. 1 and 2 show two section views of the hydraulic jack with a conventional locking mechanism, similar to the one disclosed in the international patent application WO2010133727A1. In FIG. 1 the hydraulic jack is shown in idle position whereas in FIG. 2 it is depicted in a mechanically locked situation. As shown in the figures, the hydraulic jack comprises a main body (2) and a lifting arm (3) articulated in relation to the main body (2) for allowing the elevation of a vehicle. A hydraulic cylinder (4) is responsible for activating the lifting arm (3), i.e. for exerting an ascending force on the lifting arm (3) causing it to rise. The hydraulic cylinder (4) is connected on its left end (as depicted in the figures) to the main body (2) and on its right end to a tie rod (16), which in turn is connected to the lifting arm (3). The connection between the hydraulic cylinder (4) and the main body (2) is fixed, whereas the connection between the hydraulic cylinder (4) and the tie rod (16) is articulated. As can be seen in the figures, the hydraulic cylinder (4) is always arranged in the same direction (in this case in horizontal direction), regardless of the higher or lower positioning of the lifting arm (3).

As concerns the mechanical locking mechanism, the hydraulic jack comprises a lever member (7) attached to a bushing (11) forming a unit that can be rotated in relation to the main body (2) in a locking direction (A) or in an unlocking direction (B); in this sense, the lever member (7) is actuated by a spring (8) in the locking direction (A) and can be actuated by a user in the unlocking direction (B) by operating an activation area (9) located in the exterior of the hydraulic jack. The lever member (7) turns in relation to an axis (10) that is solidary to the main body (2). The lever member (7) comprises a first curved area (12) and a second curved area (13), both of which are separated by a step or locking zone (14). The lifting arm (3) in turn comprises a solidary element, which in this case takes the form of a turning bolt (15) that acts as a stop by lodging in the locking zone (14). Then, in unlocked situations the turning bolt (15) rolls along the first curved area (12) or the second curved area (13) when the lifting arm (3) is rotated, whereby contact between the turning bolt (15) and the zones (12, 13) is maintained by the spring (8). When the elevation of the lifting arm (3) is stopped, the turning bolt (15) remains lodged in the locking zone (14) thereby preventing the descending rotation of the lifting arm (3), the turning bolt (15) and the lifting arm (3) therefore being locked in place as shown in the figure. If the user exerts pressure on the activation zone (9), the locking zone (14) moves away from the turning bolt (15) resulting in the unlocking of the lifting arm (3).

Figure 3:
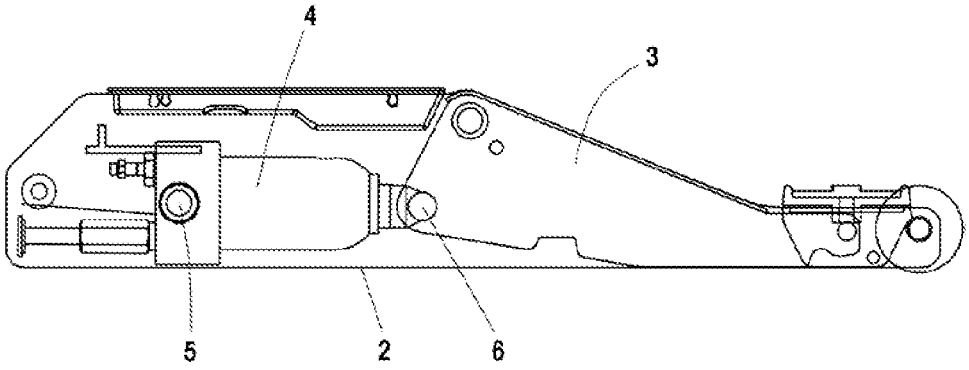
FIGS. 3 and 4 depict two section views of a conventional long hydraulic jack without mechanical locking that is provided with a hydraulic cylinder of changeable direction, where the hydraulic jack is shown in the respective idle and locked situations.
Figure 4:
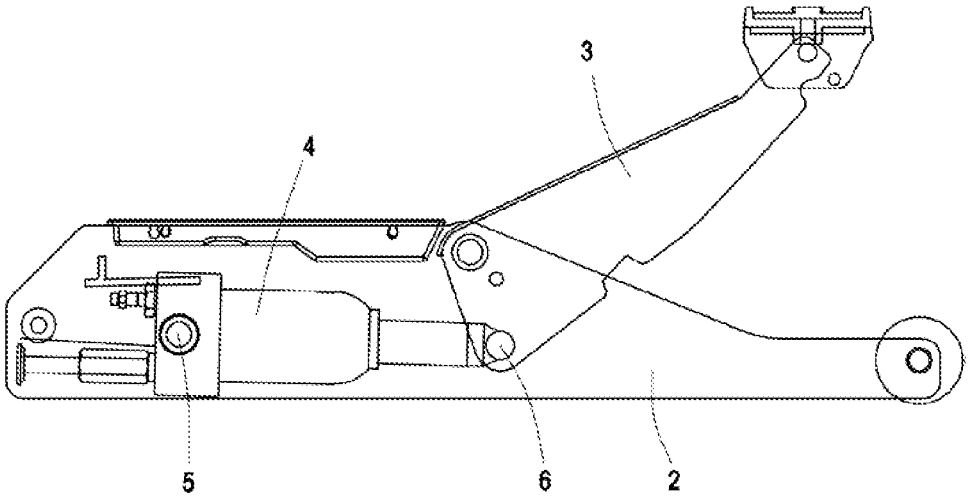

FIGS. 3 and 4 depict two section views similar to the previous ones, but in this case of a conventional long hydraulic jack, where the hydraulic cylinder (4) is connected to the main body (2) by a first articulated connection (5) and directly (without a tie rod) to the lifting arm (3) by a second articulated connection (6). The hydraulic cylinder (4) can change its direction, i.e. it tilts as the lifting arm (3) pivots in relation to the main body (2). As can be seen in the figure, the hydraulic cylinder (4) is located in this case between the rear area of the hydraulic jack and the lifting arm (3).

Figure 5:
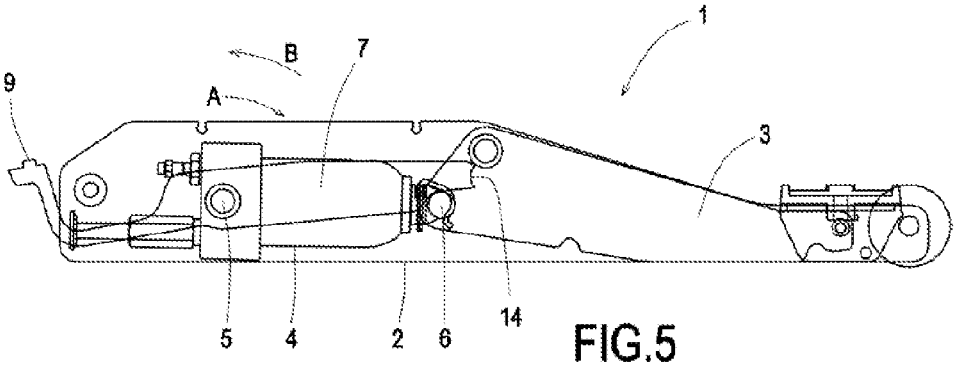
FIG. 5 shows one embodiment of a hydraulic jack according to the present invention.

FIG. 5 shows one embodiment of the hydraulic jack according to the present invention. In accordance with the invention, the hydraulic jack (1), just as the commonly known hydraulic jack, comprises a main body (2), a lifting arm (3) articulated in relation to the main body (2) for allowing the elevation of a vehicle and a hydraulic cylinder (4) for activating the lifting arm (3). The hydraulic cylinder (4) is connected to the main body (2) by a first articulated connection (5) and to the lifting arm (3) by a second articulated connection (6). The hydraulic jack (1) comprises a lever member (7) that can rotate in relation to the main body (2) in a locking direction (A) or in an unlocking direction (B) and which comprises one or several locking zones (14)—in this case only one is depicted—for receiving an element that is solidary to the lifting arm (3) and that serves as a stopping element.

The hydraulic jack (1) according to the invention introduces a special feature in that the lever member (7) is articulately connected to the main body (2) in the first articulated connection (5). In other words, the articulated connection between the lever member (7) and the main body (2) coincides with the articulated connection between the hydraulic cylinder (4) and the main body (2), i.e. it coincides with the first articulated connection (5). This way, the first articulated connection (5), which is present in any hydraulic jack with an articulated hydraulic cylinder, is also used for connecting the lever member (7) of the mechanical locking mechanism, thereby eliminating the need to use an axis (10) as shown in FIGS. 1 and 2.

In addition to that, the element solidary to the lifting arm (3), which serves as a stopping element and is capable of lodging in at least one locking zone (14), is comprised in the second articulated connection (6). In other words, an element (for example a rod) present in the second articulated connection (6) is used as a stopping element. This way, the second articulated connection (6), which is present in any hydraulic jack with a hydraulic cylinder (4) articulately connected to the lifting arm (3), is also used as a stopping element intended to lodge in a lever member (7), thereby eliminating the need to use a sole-purposed turning bolt (15) as is the case of the jack depicted in FIGS. 1 and 2.

Preferably, the mass between the locking zone (14) and the first articulated connection (5) is greater than the mass between the activation zone (9) and the first articulated connection (5) so that the lever member (7) tends to rotate in the locking direction (A) due to its own weight. These characteristics eliminate the need for a spring in the locking mechanism in order to rotate the lever member (7) in the locking direction (A), as this rotation is already caused by the force of gravity, in a simple yet at the same time controlled way.

It is also preferable that the distance between the locking zone (14) and the first articulated connection (5) of the lever member (7) be greater than the distance between the second articulated connection (6) and the first articulated connection (5) so that the lever member (7) is able to rest against the second articulated connection (6). The hydraulic jack according to the invention is also characterised in that when the lever member (7) is in a so-called "idle" situation, as shown in FIG. 5, it is resting against the second articulated connection (6) due to the force of gravity. By contrast, when the lever member (7) is in a so-called "lockable" situation, as shown in FIG. 7, the locking zone (14) of the lever member (7) is situated in the trajectory of the second articulated connection (6). The reasoning of these two properties of the lever member (7) can be understood from the description of FIGS. 6 to 9.

Figure 6:
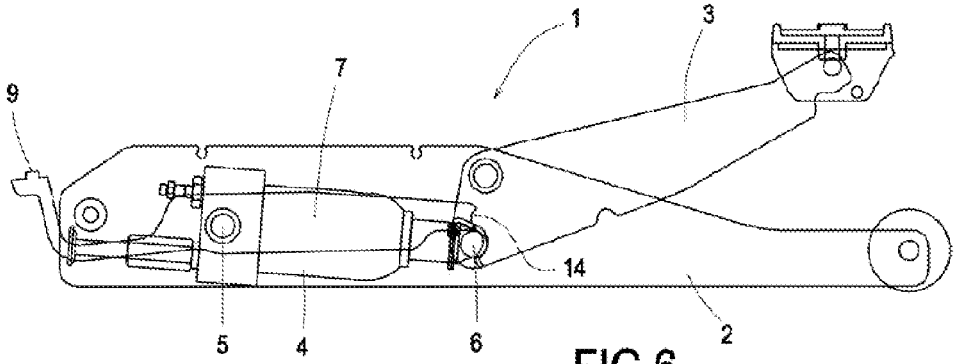
FIGS. 6 to 9 depict an operating sequence of the hydraulic jack depicted in FIG. 5.
Figure 7:
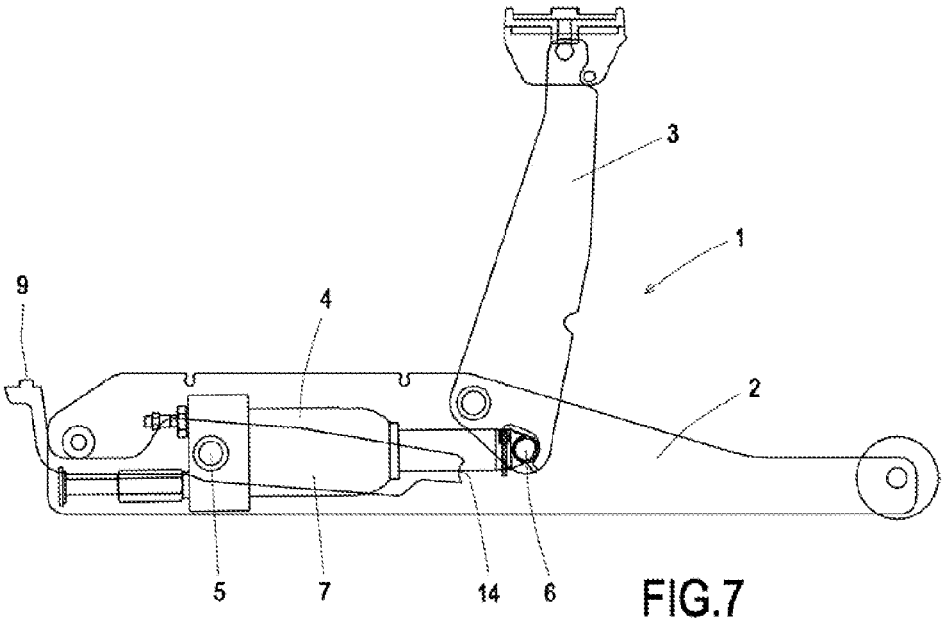
Figure 8:
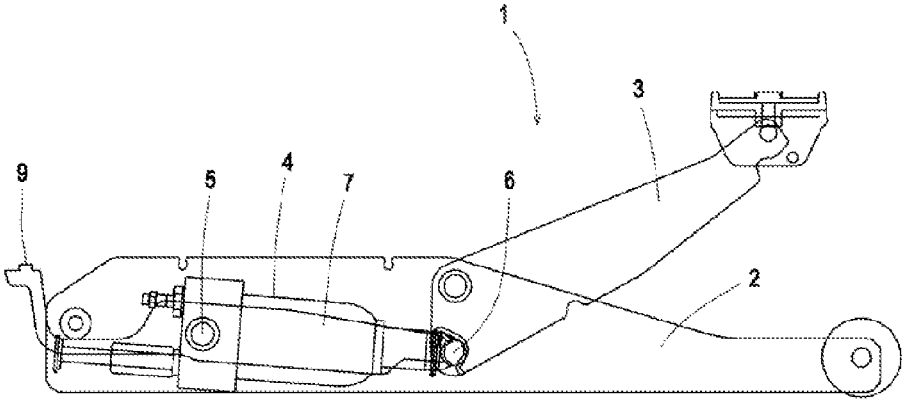

FIGS. 6 to 9 show an operating sequence (elevation, locking and unlocking) of the hydraulic jack starting from the idle situation shown in FIG. 5. Said sequence takes place as follows:

When the hydraulic system is activated, the hydraulic cylinder (4) begins to expand as shown in FIG. 6, thereby exerting a force on the second articulated connection (6) that causes the lifting arm (3) to start rising. During this first lifting phase of the lifting arm (3) in relation to the main body (2), the second articulated connection (6), which serves as a stopping element, is in contact with the lever member (7), underneath it and supporting it. This way, the lever member (7) is held in a correct position and is prevented from falling due to its own weight.

If the hydraulic system is kept activated, the hydraulic cylinder (4) will eventually expand sufficiently enough for the second articulated connection (6) to move away from underneath the lever member (7), as shown in FIG. 7. As it is no longer supported by the second articulated connection (6), the level member (7) slightly falls, thereby positioning the locking zone (14) in the descending trajectory of the second articulated connection (6).

If for whatever reason the lifting arm (3) should fall (wantingly or not), the lifting arm (3) will rotate downwards until within its descending trajectory the second articulated connection (6) meets the locking zone (14) and is lodged in it. In this situation, depicted in FIG. 8, the lifting arm (3) is mechanically locked or lodged.

Figure 9:
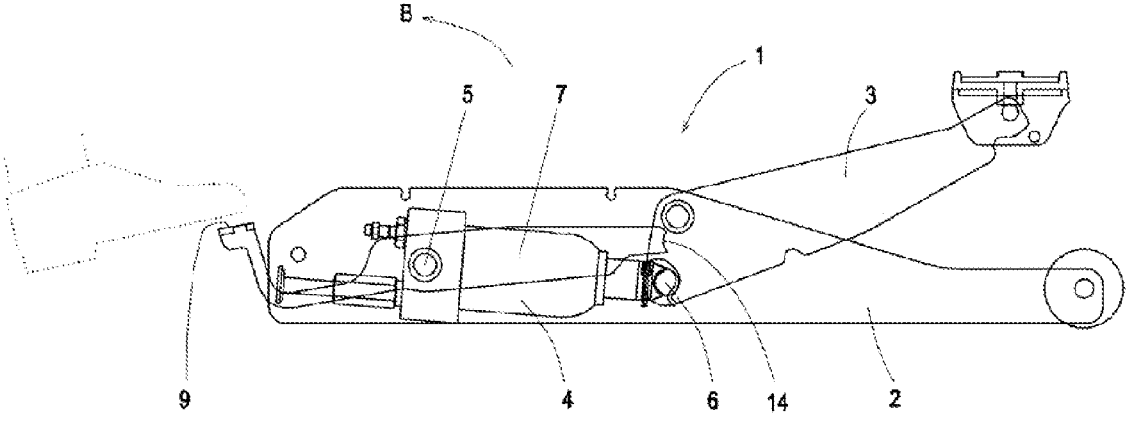

When the user steps on the activating zone (9), as shown in FIG. 9, the lever member (7) is forced to rotate in the unlocking direction (B). Consequently, the locking zone (14) moves away from and becomes positioned over the second articulated connection (6) in a way that the second articulated connection (6) and the whole lifting arm (3) are able to continue descending, as the descending trajectory of the second articulated connection (6) is now free of obstacles.

Therefore, the invention allows for a simplification of the mechanical locking design by reducing the number of parts involved in its structure, while at the same time maintaining and guaranteeing the correct performance of said locking. Specifically, it is only necessary to use a properly connected and arranged lever member (7) for obtaining an efficient locking mechanism, eliminating the need to use a spring or an axis as those illustrated in FIGS. 1 and 2. The simplification of the locking mechanism does not only hold the advantage of reducing the manufacturing costs of the locking mechanism and consequently of the entire hydraulic jack, but it also allows to retrofit hydraulic jacks that do not have a locking system in a relatively easy and economic way so that they are also provided with this useful function.

Figure 10:
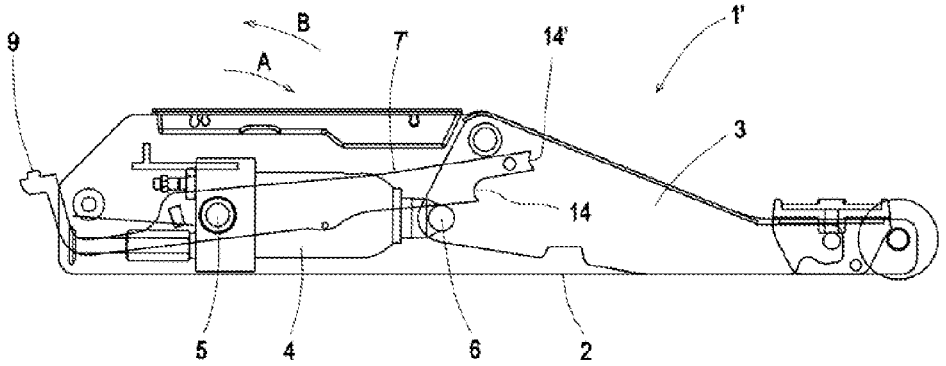
FIG. 10 shows a second embodiment of the invention, where the hydraulic jack is provided with a lever member with two locking zones.

FIG. 10 depicts a second embodiment of the invention, in which the hydraulic jack (1') is provided with a lever member (7') with two or more locking zones (14, 14')—two locking zones (14, 14') having been depicted in the referenced figures. The two locking zones (14, 14') are located in different distances from the first articulated connection (5), thus allowing for a hydraulic jack (1') that has a lifting arm (3) with two locking positions of different heights.

In this case, it is preferable that the mass between the locking zone (14') that is further away from the first articulated connection (5) and the first articulated connection (5) be greater than the mass between the activation area (9) and the first articulated connection (5), so that the lever member (7') is inclined to rotate in the locking direction (A) due to its own weight. As is the case in the previous embodiment, this eliminates the need for a spring in the locking mechanism in order for the mechanism to enter into locking mode.

It is also preferable that the distance between the locking zone (14) that is closer to the first articulated connection (5) and the first articulated connection (5) of the lever member (7') be greater than the distance between the second articulated connection (6) and the first articulated connection (5) so that in an idle situation the lever member (7') is resting against the second articulated connection (6), whereas in a lockable situation, one of the locking zones (14, 14') is situated in the trajectory of the second articulated connection (6). This way, the jack is able to lock itself automatically, without the need of an external action, simply when one of the locking zones (14, 14') is situated in the trajectory of the second articulated connection (6).

Figure 11:
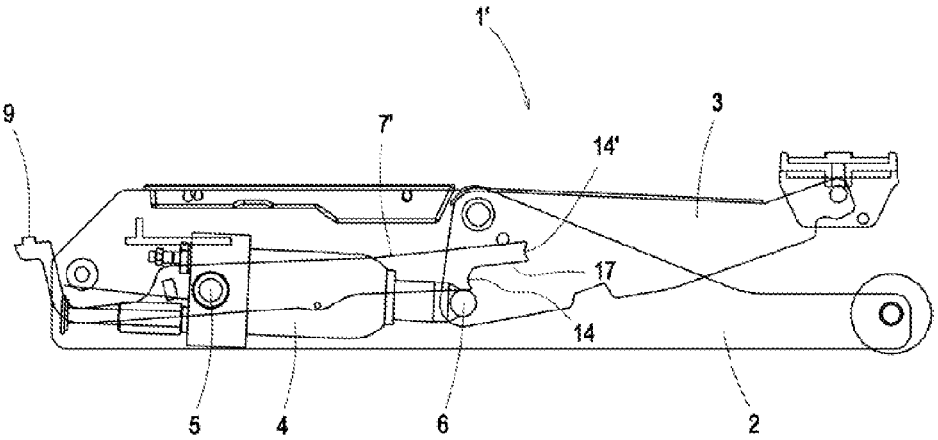
FIGS. 11 to 15 depict the operating sequence (elevation, locking and unlocking) of the hydraulic jack depicted in FIG. 5.

FIGS. 11 to 15 show an operating sequence (elevation, locking and unlocking) of the hydraulic jack starting from the idle situation shown in FIG. 5. Said sequence takes place as follows:

When the hydraulic system is activated, the hydraulic cylinder (4) begins to expand as shown in FIG. 11, thereby exerting a force on the second articulated connection (6) that causes the lifting arm (3) to start rising. During this first lifting phase of the lifting arm (3) in relation to the main body (2), the second articulated connection (6), which serves as a stopping element, is in contact with the lever member (7'), underneath it and supporting it. This way, the lever member (7') is held in a correct position and is prevented from falling due to its own weight.

Figure 12:
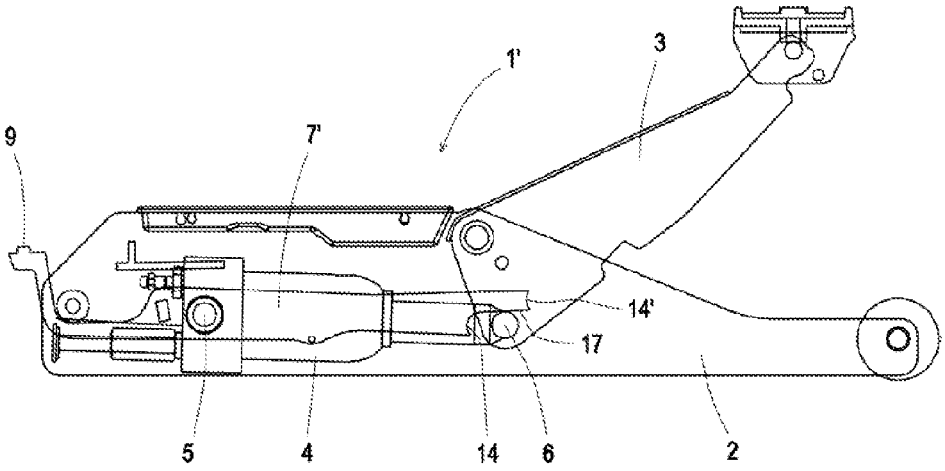
Figure 13:
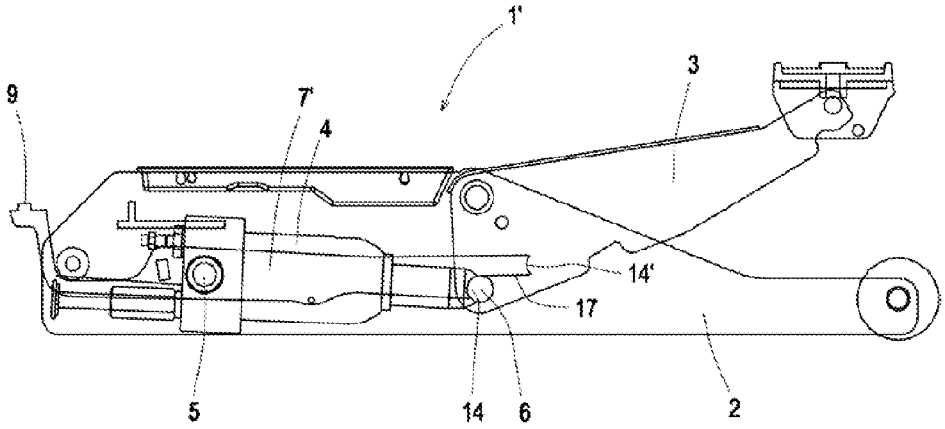

If the hydraulic system is continued to be activated, the hydraulic cylinder (4) will eventually expand sufficiently enough for the second articulated connection (6) to move past the locking zone (14) that is nearest to the first articulated connection (5), causing the rotation of the lever member (7') in the locking direction (A) due to the force of gravity. As a consequence, the second articulated connection (6) comes in contact with a second section (17) and the locking zone (14) is now situated in the descending trajectory of the second articulated connection (6), as can be seen in FIG. 12.

If for whatever reason the lifting arm (3) should fall (wantingly or not), the lifting arm (3) will rotate downwards until within its descending trajectory the second articulated connection (6) meets the locking zone (14) and is lodged in it. In this situation, depicted in FIG. 13, the lifting arm (3) is mechanically locked or lodged in a first locking position.

Figure 14:
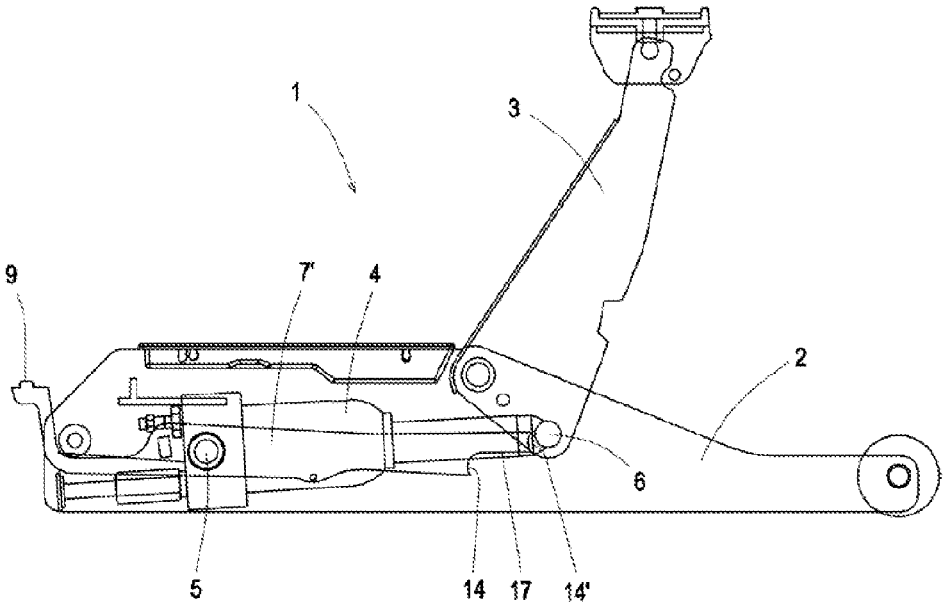
Figure 15:
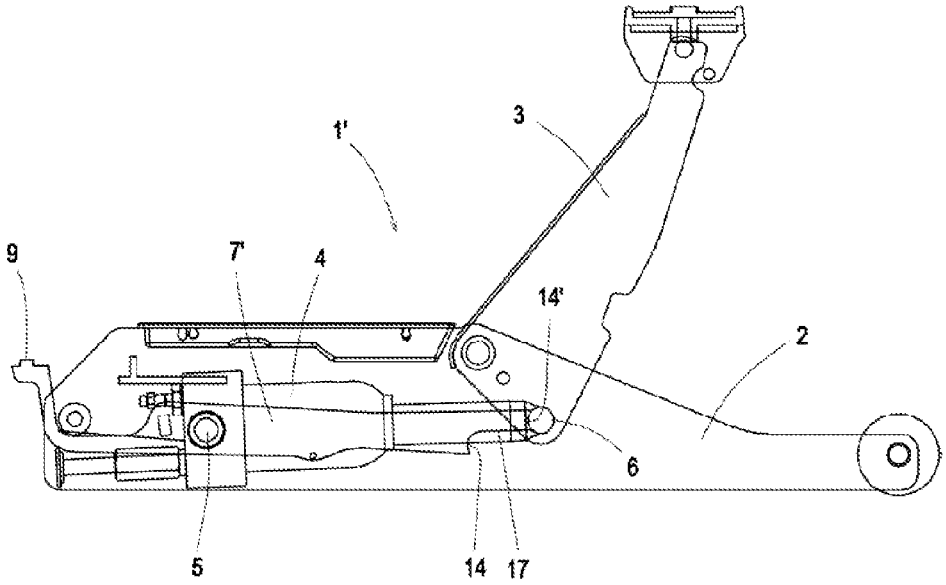

If the hydraulic cylinder (4) is kept activated in order to continue raising the lifting arm (3), the latter rises in a way that the second articulated connection (6) rolls along the second section (17) until it moves past the second locking zone (14') as shown in FIG. 14.

Consequently, the lever member (7') rotates in the locking direction (A) due to the force of gravity, until the second locking zone (14') is situated in the descending trajectory of the second articulated connection (6).

If for whatever reason the lifting arm (3) should fall, the lifting arm (3) will rotate downwards until within its descending trajectory the second articulated connection (6) meets the locking zone (14') and is lodged in it. In this situation, depicted in FIG. 15, the lifting arm (3) is mechanically locked or lodged in a second locking position that is higher than the previous one.

The unlocking of the lifting arm (3)—not illustrated—is performed in a similar way as in the preceding embodiment: when the user steps on the activating zone (9), the lever member (7') is forced to rotate in the unlocking direction (B) thereby moving away from the second articulated connection (6); consequently, the second articulated connection (6) and the whole lifting arm (3) are able to continue descending, as the descending trajectory of the second articulated connection (6) is now free of obstacles.

The invention claimed is:

1. A hydraulic jack (1, 1') that comprises a main body (2), a lifting arm (3) articulated in relation to the main body (2) to allow lifting a vehicle and a hydraulic cylinder (4) for activating the lifting arm (3), where the hydraulic cylinder (4) is connected to the main body (2) by a first articulated connection (5) and to the lifting arm (3) by a second articulated connection (6), where the hydraulic jack (1, 1') comprises a lever member (7, 7') that is able to rotate in relation to the main body (2) in a locking direction (A) or in an unlocking direction (B) and which comprises at least one locking zone (14) for receiving an element that is solidary to the lifting arm (3) and that serves as a stop, characterised in that:

the lever member (7, 7') is articulately connected to the main body (2) in the first articulated connection (5);

the element solidary to the lifting arm (3) and that serves as the stop and is able to lodge in said at least one locking zone (14) is comprised in the second articulated connection (6).

2. The hydraulic jack (1) according to claim 1, characterised in that the lever member (7) comprises only one locking zone (14).

3. The hydraulic jack (1) according to claim 2, characterised in that the mass between the locking zone (14) and the first articulated connection (5) is greater than the mass between an activation zone (9) and the first articulated connection (5) so that the lever member (7) tends to rotate in the locking direction (A) due to its own weight.

4. The hydraulic jack (1) according to claim 2, characterised in that the distance between the locking zone (14) and the first articulated connection (5) of the lever member (7) is greater than the distance between the second articulated connection (6) and the first articulated connection (5), so that in an idle situation the lever member (7) is resting against the second articulated connection (6), whereas in a lockable situation the locking zone (14) is situated in the trajectory of the second articulated connection (6).

5. The hydraulic jack (1') according to claim 1, characterised in that the lever member (7') comprises two or more locking zones (14, 14'), located at different distances from the first articulated connection (5).

6. The hydraulic jack (1') according to claim 5, characterised in that the mass between the locking zone (14') that is further away from the first articulated connection (5) and the first articulated connection (5) is greater than the mass between the activation zone (9) and the first articulated connection (5) so that the lever member (7') tends to rotate in the locking direction (A) due to its own weight.

7. The hydraulic jack (1') according to claim 5, characterised in that the distance between the locking zone (14) that is closer to the first articulated connection (5) and the first articulated connection (5) of the lever member (7') is greater than the distance between the second articulated connection (6) and the first articulated connection (5), so that in an idle situation the lever member (7') is resting against the second articulated connection (6), whereas in a lockable situation one of the locking zones (14, 14') is situated in the trajectory of the second articulated connection (6).

* * * * *